US005683510A

United States Patent [19]

Li et al.

[11] Patent Number: 5,683,510

[45] Date of Patent: Nov. 4, 1997

[54] COATER WITH AIR COLLECTOR

[75] Inventors: Alfred C. Li, Naperville, Ill.; Rex A. Becker, Janesville, Wis.; James R. Burns, Springfield, Pa.

[73] Assignee: Beloit Technologies, Inc., Wilmington, Del.

[21] Appl. No.: 563,127

[22] Filed: Nov. 29, 1995

[51] Int. Cl.[6] ..... B05C 3/02

[52] U.S. Cl. ..... 118/410; 118/419

[58] Field of Search ..... 118/410, 411, 118/419, 413

[56] References Cited

U.S. PATENT DOCUMENTS

| | | | |
|---|---|---|---|
| 4,357,370 | 11/1982 | Alheid | 427/211 |
| 4,761,309 | 8/1988 | Embry | 427/294 |
| 4,834,018 | 5/1989 | Sollinger et al. | 118/410 |
| 4,839,201 | 6/1989 | Rantanen et al. | 427/355 |
| 4,860,686 | 8/1989 | Kato et al. | 118/410 |
| 4,880,671 | 11/1989 | Sollinger et al. | 427/356 |
| 4,903,632 | 2/1990 | Sollinger | 118/123 |
| 4,961,968 | 10/1990 | Shands et al. | 427/356 |
| 5,183,691 | 2/1993 | Hassell et al. | 427/286 |
| 5,192,591 | 3/1993 | Chance | 427/356 |
| 5,199,991 | 4/1993 | Chance | 118/410 |
| 5,370,735 | 12/1994 | Beisswanger | 118/249 |

OTHER PUBLICATIONS

"Optiblade™–a new method for high–speed LWC coating", by J. Linnonmas and M. Tyrväinen, PaperNews, Dec. 14, 1995, pp. 18–20.

"BA1500™ Coater: Versatile, highspeed blade applicator produces quality coated papers," a brochure by Rader Companies, a division of Beloit Corporation.(Jun., 1994).

"New Coating Technologies Combine High Speeds with Higher Quality, " an article published in Pulp & Paper by Andy Harrison pp. 60–64 –May 1994.

*Primary Examiner*—Brenda Adili Lamb

*Attorney, Agent, or Firm*—Dirk J. Veneman; Raymond W. Campbell; Gerald A. Mathews

[57] ABSTRACT

Air entrained within the pond of a coating applicator is influenced toward a designated region for removal. The region is formed by a recessed air collector which sets up a high-recirculation, low-pressure zone within the pond. Entrained air bubbles migrate to the collector. The collected air and excess coating is drawn out of the collector cavity by a plurality of perforations which discharge to a collection cavity at a lower pressure or partial vacuum. The collector structure may be employed in various coater/size press configurations.

19 Claims, 4 Drawing Sheets

78
24
20
62
22
23
26
36

COATER WITH AIR COLLECTOR

FIELD OF THE INVENTION

The present invention relates to apparatus for applying coatings to moving substrates.

BACKGROUND OF THE INVENTION

Paper of specialized performance characteristics may be created by applying a thin layer of coating material to one or both sides of the paper. The coating is typically a mixture of a fine plate-like mineral, typically clay or particulate calcium carbonate; coloring agents, typically titanium dioxide for a white sheet; and a binder which may be of the organic type or of a synthetic composition.

Coated paper is typically used in magazines, commercial catalogs and advertising inserts in newspapers and other applications requiring specialized paper qualities. With the increasing demand for lighter weight, lower cost coated papers, there is an increasing need for more efficiency in the production of coated paper grades.

Paper is typically more productively produced by increasing the speed of formation of the paper. Coating costs are kept down by coating the paper while still on the papermaking machine. Because the paper is made at higher and higher speeds and because of the advantages of on-machine coating, the coaters in turn must run at higher speeds. The need in producing lightweight coatings to hold down the weight of the paper and the costs of the coating material encourages the use of short dwell coaters which by subjecting the paper web to the coating material for a short period of time and limit the depth of penetration of the coating and hence the coating weight.

Thus, high speed coater machines are key to producing lightweight coated papers cost-effectively.

A typical coating applicator has a coating pond which serves as an application zone. One of the boundary walls of the application zone is provided by the moving substrate. A substrate can be comprised of a web, felt, blanket, plate, roll, or any other medium to which a film of coating is to be applied. Coating within the pond is effectively transferred onto the substrate. The substrate enters the pond through an overflow region where it makes initial contact with the coating fluid at the dynamic contact line. A boundary layer is established adjacent to the moving substrate as it propagates through the pond. The substrate exits the pond at a metering element. The pond provides a means for accelerating the coating fluid up to the speed of the moving substrate by allowing internal flow recirculation and attenuating the cross-machine direction flow variations by permitting overflow through the baffle. In general, the residence time is short for the substrate, but can be relatively long for the coating fluid.

However, higher speed papermaking has placed greater demands on the short dwell coater. In general, increased operating speed causes a degradation of coated paper quality. One of the major problems associated with high speed coating is the appearance of macroscopic machine direction and cross-machine direction streaks on the paper. An order of magnitude analysis suggests that this streaking problem can be attributable to flow instabilities resulting from the interaction of multiple events in the application zone, such as the existence of dimensionally unstable vortexes, entrainment of air at the dynamic contact line and through the feed system, lack of uniformity at the dynamic contact line, and instabilities at the boundary layer next to the moving substrate.

It appears that a coupling of the entrained air with the dimensionally unstable vortexes in the coating pond play an important role in generating the undesirable streaks. Air can be entrained and enter the coater pond due to the inability of the coating fluid to completely and uniformly displace the boundary layer of air adjacent to the fast moving substrate in a rather short time interval. It is apparent that the mechanisms of how air is being entrained and how the entrained air affects the coat weight distribution are still unclear. Experimental observations from a see-through cavity show that the entrained air accumulates in the coating pond, eventually forming an air pocket in the inner region of a high recirculation zone. The air pocket grows until a critical size is reached, and then breaks down chaotically. The disturbance induced by sudden air pocket breakdown may generate two possible situations: first a rejection of air and excess coating out of the pond at the free surface, creating a disruption in the outflow pattern and possibly an instantaneous local pressure drop in the system, and second, the propulsion of some of the air toward the blade creating additional blade vibration.

Mechanical means of preventing the air from entering the application zone have been proposed, including use of an additional blade next to the outflow region to cut down the incoming boundary layer of air, supplying the coating fluid under pressure in the form of a jet to reduce the relative velocity between the moving substrate and the coating fluid, and use of a partial vacuum to replace the gas phase, as is commonly adopted in the slot and slide coaters for use in the photographic industry. In general, runnability may be adversely affected with a two blade system. Matching the velocity of high viscosity coating fluid to that of the moving substrate is difficult at high machine speed and air tends to act as a lubricant or shield for the substrate. The partial vacuum method is limited to low speed applications. At high machine speeds, it seems that there is no effective means to totally exclude the boundary layer of air from entering the application zone.

Since prevention of air from entering the application zone of a coater appears to be extremely difficult, what is needed is a means for controlling entrained air which has entered the application zone to thereby maintain coating consistency and quality.

SUMMARY OF THE INVENTION

The coating applicator of this invention controls entrained air in the application zone by influencing the air to a designated region and then removing it from that region. The coaters of this invention effectively capture the entrained air bubbles and thereby allow air/coating flow separation in the applicator zone. A recessed cavity is positioned within the coating pond. The cavity creates a high-recirculation, low-pressure zone for the entrapment of air bubbles. The cavity has one or more perforations, through which coating and entrapped air are withdrawn. Perforations may be provided in the lower pond wall after the air collector cavity to further attenuate flow variations.

It is a feature of the present invention to provide a coating applicator which controls entrained air in the application zone by attracting the air to a designated area and then removing it.

It is another feature of the present invention to provide a coating applicator which applies coatings to a substrate moving at high speed in a consistent manner.

It is a further feature of the present invention to provide a coater which reduces machine-direction and cross-machine direction streaks in the coated substrate.

It is an additional feature of the present invention to provide an entrained air control feature for coating applicators which may be employed with a wide variety of coater types.

It is also a feature of the present invention to provide a coater which attenuates flow variations in the coating application zone.

Further objects, features and advantages of the invention will be apparent from the following detailed description when taken in conjunction with the accompanying drawings.

DESCRIPTION OF THE PREFERRED EMBODIMENT

Figure 1:
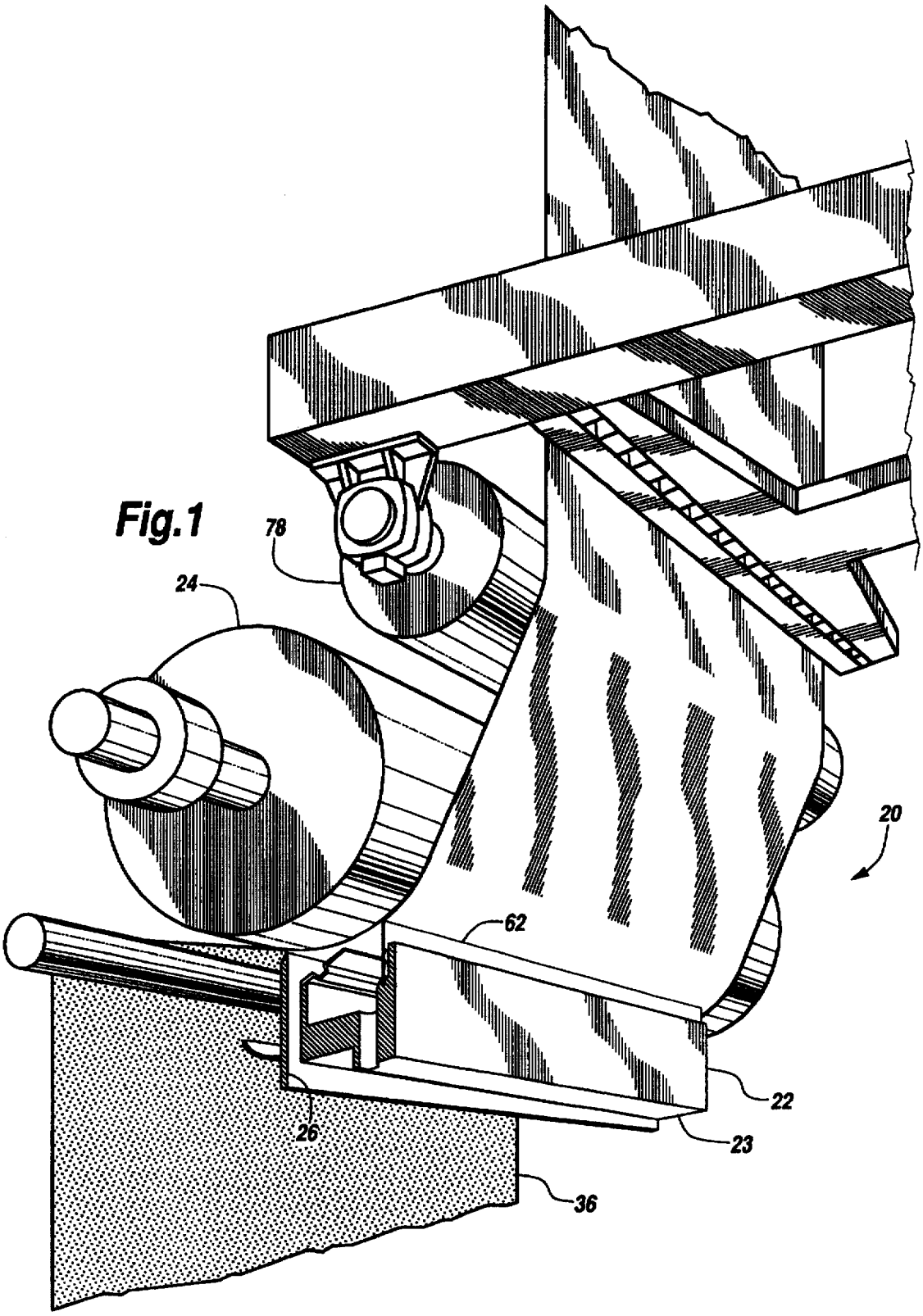
FIG. 1 is an isometric view, partly cut-away, of the coater of this invention with a substrate extending therethrough.
Figure 2:
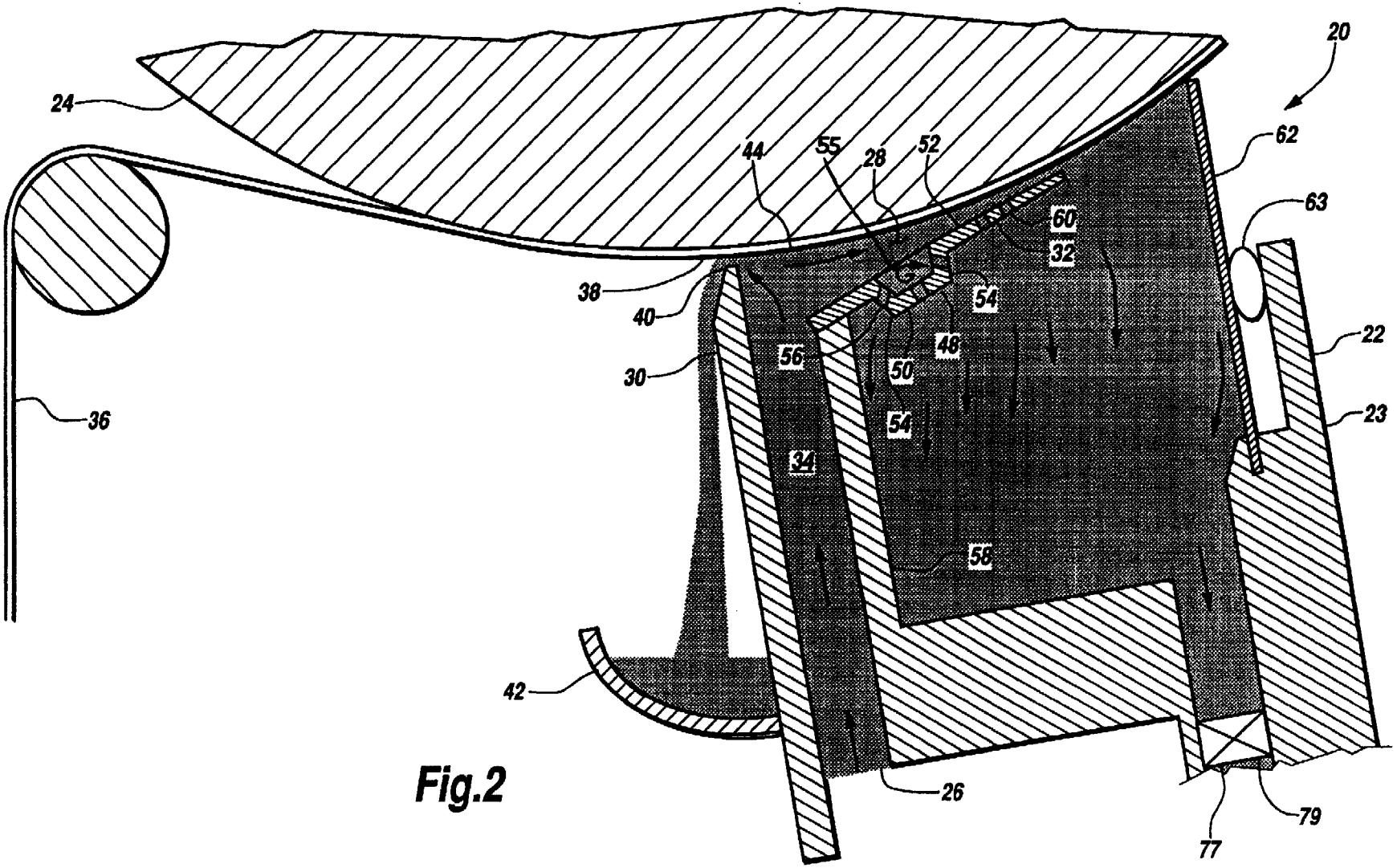
FIG. 2 is a cross-sectional view of the coater of FIG. 1

Referring more particularly to FIGS. 1-4, wherein like numbers refer to similar parts, a coater 20 of the present invention is shown in FIGS. 1 and 2. An uncoated substrate 36 passes through the coater 20 for application of the desired surface coating. The coater 20 has a coater head 22 which extends at least the width of the web and which is positioned beneath a backing roll 24. The coater head 22 has a rigid housing 23 which extends in the cross-machine direction and which has an inlet 26 through which coating is introduced to a pond 28 formed between a forward baffle plate 30 and an inclined application member or wedge member 32. The pond 28 defines an application region of coating 34 to the substrate 36.

The coating 34 is applied from the pond 28 to the substrate 36 which passes between the backing roll 24 and the coater head 22. A gap 38 is defined between the upper lip 40 of the baffle plate 30 and the substrate 36. The coating 34 overflows the baffle plate 30 and is allowed to escape the pond 28 through the gap 38. The gap 38, which is typically up to one inch high, and preferably between one-sixteenth and one-quarter of an inch high, is used to decrease the amount of air which is carried by the boundary layer of the substrate 36 into the pond 28. The overflow or flood of coating 34 which flows through the gap 38 displaces a portion of the air boundary layer. The overflow then flows into a trough 42 which is positioned frontward of the baffle plate 30. The overflowing coating 34 is collected in the trough 42 and recycled. A dynamic contact line 44 is formed where the coating 34 displaces the boundary layer.

As machine speeds are constantly increased, sheet quality becomes a problem as coating uniformity deteriorates. At machine speeds above thirty-five hundred feet per minute, certain formulations of coating develop low coat weight streaks and blotches, marring the appearance of the base sheet and thereby reducing the operation window within which the product may be made. The entrained air which enters the pond 28 is dealt with by influencing it to a designated region formed by an air collector 48, and then removing it from that region.

The air collector 48, as shown in FIG. 2, is a depressed recess formed on the application wedge 32 within the pond 28. The recessed collector has a bottom wall 50 which is generally parallel to and below the contact application surface 52 of the application wedge 32. Side walls 54 extend between the collector bottom wall 50 and the application surface 52.

Coating material 34 is fed under pressure through the inlet 26 and flows out over the lip in the upstream direction. At the same time, the rapidly moving substrate 36 engages coating within the pond 28 and advances it in the downstream direction. A vortex 55 is created by the recirculation of coating within the pond. Movement of the coating fluid creates a recirculation zone in the collector 48. This region of lower pressure can then be breached by the air bubbles which have been incorporated in the recirculating pond coating by induction from the substrate/air boundary layer and the feed supply.

The capture of air bubbles from fluids is characterized by the simultaneous action of buoyancy, viscous, inertial, centrifugal, and normal (viscoelastic) forces, that act between the air bubbles and collector. These combined forces govern the bubble trajectories which in turn determine whether the air bubbles tend to migrate toward the air collector within which the high-recirculation, low-pressure zone is established.

If the accumulated air bubbles are not removed, they will combine and eventually form a large bubble which will burst and disrupt the coating application. To remove the accumulated bubbles, a plurality of perforations 56 are included in the bottom wall 50 and side walls 54 of the collector 48. Coating 34 and entrained air continuously flows through the perforations 56 and is discharged into a collection chamber 58. The coating 34 collected in the collection chamber 58 is recirculated and resupplied to the pond 28. The collection chamber 58 may be maintained at a lower pressure through the use of partial vacuum conditions. Alternatively, any deaerating device may be connected to the air collector 48 for air removal. By creating a high recirculation area which induces air bubble migration to the collector, much of the entrained air is collected and removed. The air collector 48 also induces a flow separation between the air and the coating, and furthermore serves to dampen out macroscopic flow variations as the result of non-uniform feed.

Coating 34 advances past the air collector 48 along the application surface 52 of the application wedge 32. Because the application surface 52 is angled with respect to the moving substrate 36, the distance between the substrate and the surface 52 decreases as the substrate moves downstream. In the region of the application wedge 32 downstream of the air collector 48, a plurality of perforations 60 may be included which extend from the pond to the collection chamber 58. The perforations 60 serve to further attenuate flow variations which might otherwise adversely affect coating uniformity.

A metering blade 62 engages against the coated substrate 36 downstream of the application wedge 32. The substrate 36 passes over the metering blade 62 where the majority, typically ninety percent, of the coating is scraped away leaving a uniform layer of coating on the substrate. An inflatable air tube 63 engages against the midpoint of the metering blade 62 for adjustable control of the thickness of the coating applied by the metering blade. The removed coating 34 may be collected and recirculated from the collection chamber 58. The coated substrate 36 then leaves the backing roll 24 and passes over a turning roll 78 and enters a dryer section (not shown). The coater 20 is a reverse feed with a pre-metered converging channel. Although a single air collector 48 has been illustrated, it may be desirable in certain circumstances to position two or more collectors along the application wedge 32. As shown in FIG. 2, a valve 79 is positioned at the recirculation outlet 77 for pressure control.

Figure 3:
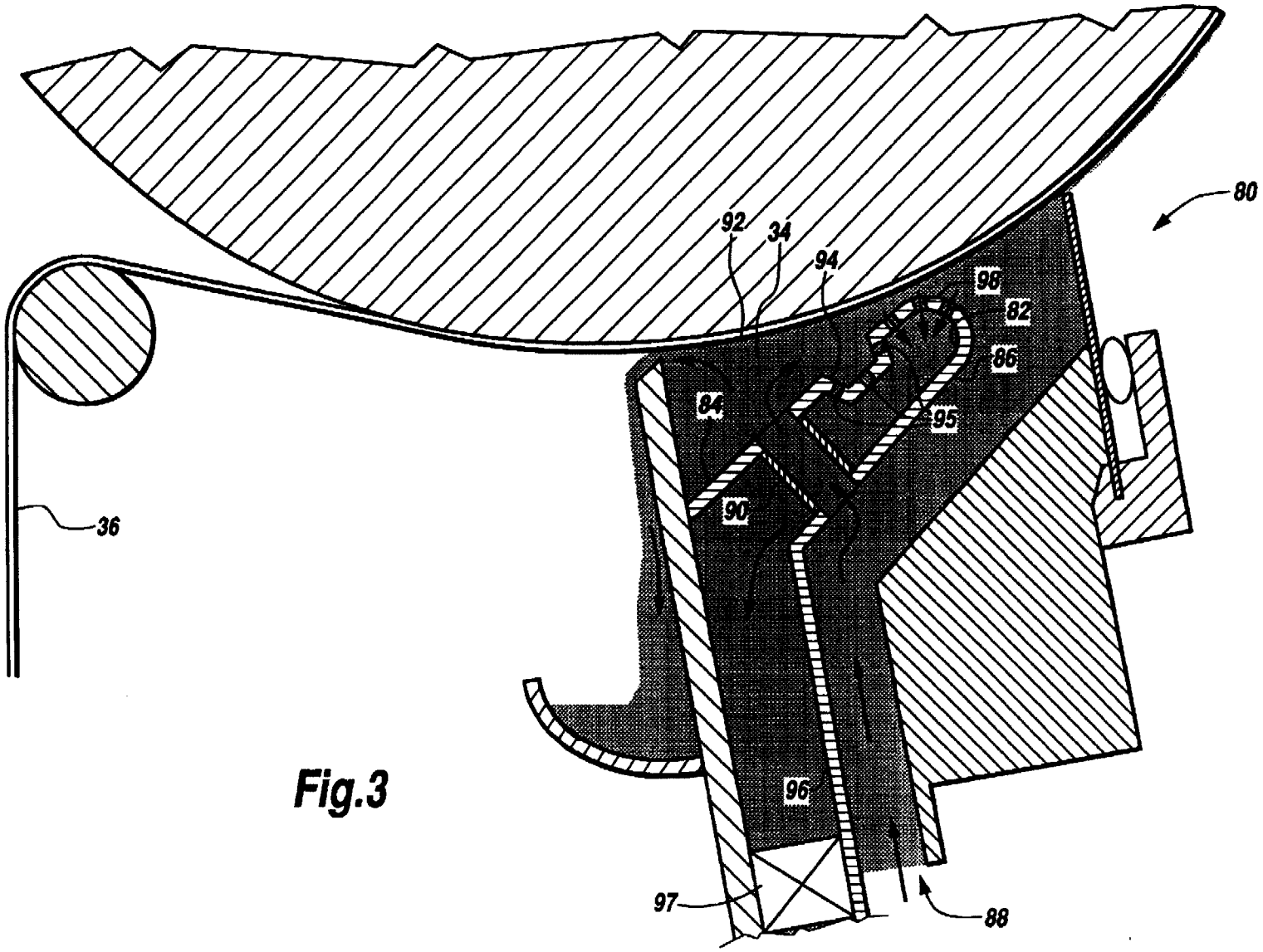
FIG. 3 is a cross-sectional view of an alternative embodiment coater of this invention having structure for a reverse feed of coating and in-pond coating extraction.

In addition, the principles of the air collector make its inclusion in other designs of coating applicators also desirable. A short dwell coater 80 with in-pond extraction is shown in FIG. 3. The coater 80 has a reduced pressure chamber 82 with an upper wall formed by a converging plate 84. The reduced pressure chamber 82 extends within an excess coating collection chamber 86 which is connected to the coating inlet channel 88. Coating 34 is fed under pressure into the coating inlet channel 88 and enters the collection chamber 86. A coating passage 90 extends through the low pressure chamber 82 and is not connected to the low pressure chamber. The coating passage 90 connects the coating pond 92 and the collection chamber 82. Coating is pumped into the pond 92 and then flows over an air collection cavity 94 which is recessed in the converging plate 84. The air collector 94 has a plurality of perforations 95 formed therein, through which air and coating exits the pond through a recirculation channel 96 for recirculation. A plurality of perforations 98 are formed in the converging plate 84 downstream of the air collector which also draw excess coating therethrough. A valve 97 is positioned in the recirculation channel for pressure control.

Figure 4:
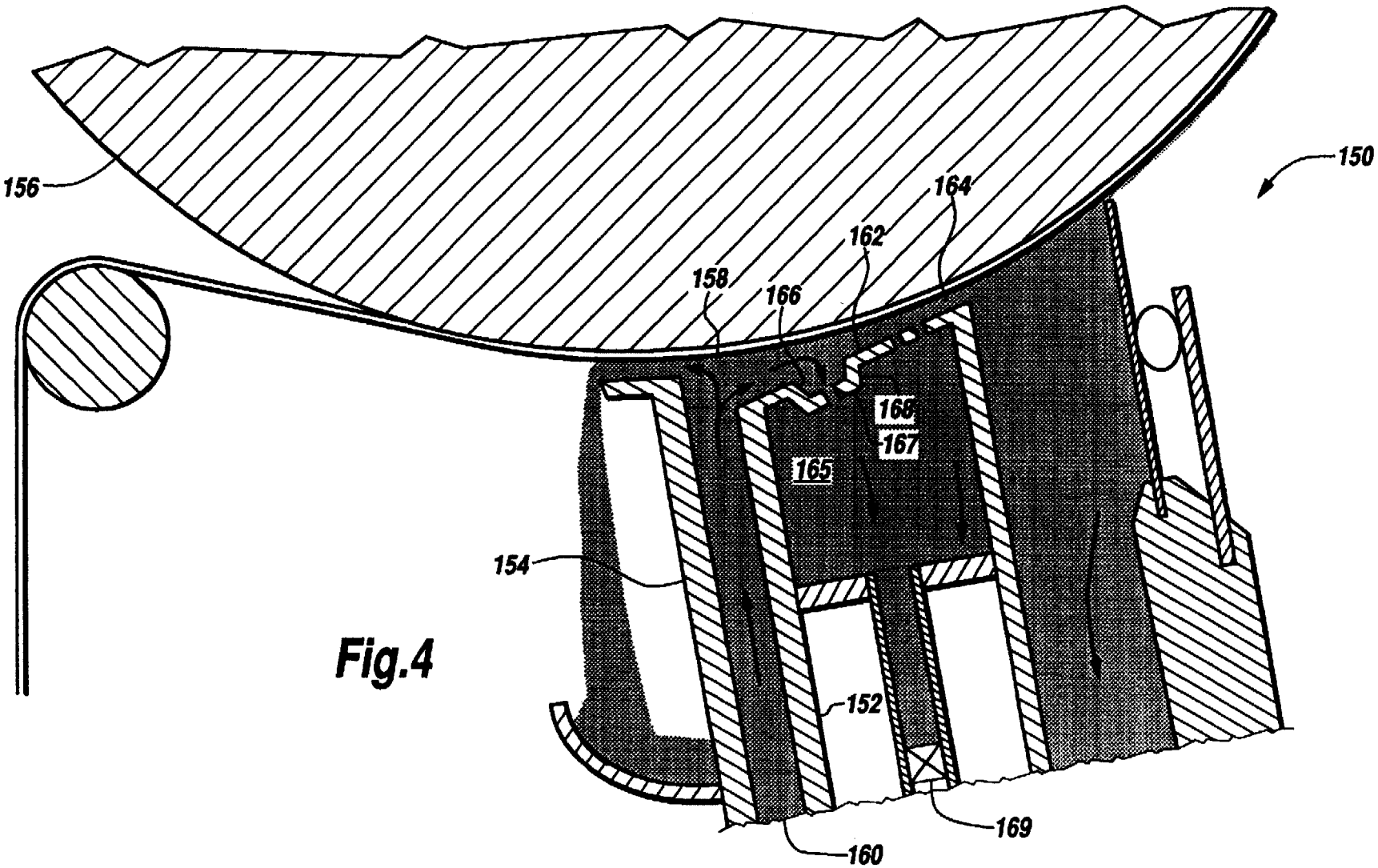
FIG. 4 is a cross-sectional view of another alternative embodiment coater of this invention having a controlled low-pressure chamber.

Another coater 150 of this invention is shown in FIG. 4. The coater 150 has a coater head 152 with a housing 154 which is positioned closely spaced from the backing roll 156. The pond 158 is fed from a coating inlet 160. An application wedge 162 defines the lower surface of the pond 158 and forms a converging gap 164 between the substrate 36 and the wedge 162. A low pressure chamber 165 is located beneath the application wedge 162. The low pressure chamber 165 is connected to a pressure control means 169 for controlling the pressure within the chamber such as, for example, a vacuum pump with a valve and pressure sensor. An air collector 166 is formed as a recess in the application wedge. A plurality of perforations 167 extend through the walls 168 of the air collector, to connect with the low pressure chamber 165. As discussed above, the air collector accumulates air bubbles, which are removed, along with excess coating, through the perforations 167 into the low pressure chamber. Coating which is collected in the low pressure chamber 165 is recirculated for eventual application to the substrate.

A paper coating is typically comprised of a plate-like filling material such as clay or calcium carbonate; a whitening agent, typically titanium dioxide; and a binder such as casein hide glue or a synthetic glue. The coating is typically applied in a slurry containing forty to sixty percent dry weight of coating materials. It should be understood, however, that the coater 20 can be employed with coatings of various viscosity and dry solid content depending on the type of substrate being coated and the thickness of the coating being formed.

It should be noted that the air collector of this invention, although shown in various short dwell coater configurations, may be employed in other coaters where it is desired to reduce the effects of entrained air on the application consistency. The dimensions and geometry of the recessed air collector may also be varied, as well as the number and location of collectors. Furthermore, although the apparatus of this invention has been illustrated in a web coating application, a similar apparatus may be employed for coating an application roll in a size press application.

It is understood that the invention is not limited to the particular construction and arrangement of parts herein illustrated and described, but embraces such modified forms thereof as come within the scope of the following claims.

We claim:

1. A coater apparatus for applying coating material to a substrate carried on a rotatable backing roll, said apparatus comprising:

a coater head housing disposed in close proximity to the backing roll such that the substrate guided by the backing roll moves between the backing roll and the coater head housing, wherein the coater head housing defines a pond which opens toward the substrate and which extends along the substrate in a cross-machine direction, and wherein the pond receives and retains coating material, and wherein the pond is connected to a pressurized source of coating material;

portions of the coater head housing which define a baffle plate upstream of the pond, wherein the baffle plate has portions defining a lip spaced from the backing roll, and wherein excess coating material within the pond overflows the baffle plate lip to escape the pond;

a wedge member which is fixed to the housing and which defines an application region between the wedge member and the substrate, wherein the wedge member has an application surface which more closely approaches the substrate as the wedge member extends downstream;

portions of the wedge member which define an air collector recess which is depressed below the wedge member application surface; and a low pressure chamber which connects with the pond through perforations in the wedge member which extend through the air collector recess, wherein the coating flows over the air collector recess, setting up a recirculation region within the air collector recess which collects air entrained within the coating, and wherein air and excess coating are drawn out of the air collector recess to the low pressure chamber.

2. The apparatus of claim 1 wherein the air collector recess is defined by a bottom wall which is substantially parallel to the wedge member application surface, and side walls which extend between the air collector recess bottom wall and the wedge member application surface.

3. The apparatus of claim 1 further comprising a metering element which engages the coated substrate downstream of the wedge member and removes a portion of the coating thereon, wherein the metering element defines a wall of the low pressure chamber, and wherein the coating removed from the substrate by the metering element enters the low pressure chamber.

4. The apparatus of claim 3 further comprised of a leveling or smoothing device which is a blade.

5. The apparatus of claim 1 wherein the coating is fed to the pond at a location upstream of the wedge member relative to the path of movement of the substrate.

6. The apparatus of claim 1 wherein the coating is fed to the pond through a coating inlet that extends through the coater head housing and connects with the pond at a position intermediate between the inlet baffle and the air collector recess.

7. The apparatus of claim 1 further comprising portions of the wedge member downstream of the air collector recess which define a plurality of perforations in the application surface which extend between the pond and the low pressure chamber.

8. The apparatus of claim 1 wherein the low pressure chamber is maintained at atmospheric pressure.

9. The apparatus of claim 1 wherein the low pressure chamber is maintained at lower than atmospheric pressure.

10. A coater for applying coating material to a substrate, the coater comprising:

a rotatable backing roll which engages the substrate to be coated;

a coater head housing positioned adjacent the substrate and the backing roll, wherein the housing defines a pond which opens toward the web and which extends along the web in a cross-machine direction, and wherein the coating is fed under pressure to the coater head housing and into the coating pond;

a wedge member fixed to the coater head housing within the pond, wherein the wedge member extends toward the substrate to define a wedge-shaped application region of the pond, and wherein the wedge member has an application surface over which coating travels, and wherein coating is applied from the pond above the wedge member to the substrate;

portions of the wedge member which define a recessed air collector recess which is depressed below the application surface;

portions of the coater head housing which define a low pressure chamber; and portions of the application surface which define perforations in the air collector recess which connect between the air collector recess and the low pressure chamber, wherein entrained air and coating within the air collector recess flow through the air collector recess perforations into the low pressure chamber.

11. The apparatus of claim 10 wherein the air collector recess is defined by a bottom wall which is substantially parallel to the application surface, and side walls which extend between the air collector bottom wall and the application surface.

12. The apparatus of claim 10 further comprising a metering element which engages the substrate downstream of the wedge member and removes a portion of the coating thereon, wherein the metering element defines a wall of the low pressure chamber, and wherein the coating removed from the substrate by the metering blade enters the low pressure chamber.

13. The apparatus of claim 10 wherein the coating is fed to the pond at a location upstream of the wedge member.

14. The apparatus of claim 10 wherein the coating is fed to the pond through an inlet that extends through the coater head housing and connects with the pond at a position intermediate the baffle upstream of the wedge member and the air collector recess.

15. The apparatus of claim 10 further comprising portions of the application surface downstream of the air collector recess which define a plurality of perforations which extend between the pond and the low pressure chamber.

16. The apparatus of claim 10 wherein the low pressure chamber is maintained at a pressure level lower than that of the pond.

17. The apparatus of claim 10 wherein the low pressure chamber is maintained at lower than atmospheric pressure.

18. A short dwell coater apparatus for applying coating material to a substrate carried on a rotatable backing roll; said apparatus comprising:

a coater head housing disposed in close proximity to the backing roll, wherein the substrate is guided by the backing roll, and wherein the coater head housing defines a pond chamber which opens toward the backing roll and which extends along the backing roll in a cross-machine direction, and wherein the pond receives and retains coating material, and wherein the pond is connected to a pressurized source of coating material;

portions of the coater head housing which define a baffle plate upstream of the pond, wherein the baffle plate has portions defining a lip spaced from the backing roll, and wherein excess coating material within the pond overflows the baffle plate lip to escape the pond;

a wedge member which is fixed to the housing and which defines an application region between the wedge member and the backing roll, wherein the member has an application surface which more closely approaches the backing roll as the wedge member extends downstream;

portions of the wedge member which define an air collector recess which is depressed below the wedge member application surface; and a low pressure chamber which connects with the coating pond through perforations in the air collector recess, wherein coating flows over the air collector recess, setting up a recirculation region within the recess which collects air entrained within the coating, and wherein air and excess coating flow out of the air collector recess to the low pressure chamber.

19. The apparatus of claim 18 further comprising a final metering element.

* * * * *